United States Patent [19]

Baker

[11] Patent Number: 4,467,867

[45] Date of Patent: Aug. 28, 1984

[54] SUBTERRANEAN WELL SAFETY VALVE WITH REFERENCE PRESSURE CHAMBER

[75] Inventor: John R. Baker, Houston, Tex.

[73] Assignee: Baker Oil Tools, Inc., Orange, Calif.

[21] Appl. No.: 395,233

[22] Filed: Jul. 6, 1982

[51] Int. Cl.[3] ..... E21B 34/08

[52] U.S. Cl. ..... 166/188; 166/332; 166/321; 277/135

[58] Field of Search ..... 166/319, 321, 332, 188, 166/187, 185, 183, 151, 149, 142, 264, 250, 128, 127, 126; 277/135

[56] References Cited

U.S. PATENT DOCUMENTS

| | | | |
|---|---|---|---|
| 3,827,501 | 8/1974 | Johnson et al. | 166/321 |
| 4,252,188 | 2/1981 | Fredd | 166/188 |
| 4,341,266 | 7/1982 | Craig | 166/321 |
| 4,361,188 | 11/1982 | Russell | 166/321 |
| 4,378,850 | 4/1983 | Barrington | 166/321 |

*Primary Examiner*—Stephen J. Novosad
*Assistant Examiner*—William P. Neuder
*Attorney, Agent, or Firm*—Norvell & Associates

[57] ABSTRACT

A subsurface safety valve for use in subterranean oil and gas well which is actuated by pressure fluctuations in the tubing-casing annulus is disclosed. The safety valve assembly consists of a safety valve mounted in a packer which is actuated by a subsurface control located above the packer. Annulus pressure variations are controlled by a surface unit. The subsurface control utilizes a reference pressure chamber in which the pressure is initially adjustable to compensate for hydrostatic pressure in the annulus. Leakage of the gas in a dome pressure chamber in the subsurface control is impeded by the presence of a barrier fluid impervious to the passage of gas therethrough, with the barrier fluid being maintained at a higher pressure than the reference pressure in the dome charged chamber.

28 Claims, 12 Drawing Figures

SUBTERRANEAN WELL SAFETY VALVE WITH REFERENCE PRESSURE CHAMBER

BACKGROUND OF THE INVENTION

1. Field of the Invention

This invention relates to a subterranean oil or gas well safety valve system utilizing a reference pressure dome charge chamber in a subsurface control used to actuate the safety valve, and to a seal assembly for maintaining the dome charge chamber at a desired reference pressure.

2. Description of the Prior Art

It is common practice to provide subterranean oil and gas wells, particularly offshore installations, with a downhole safety valve which automatically shuts in the event of a problem at the well head which might otherwise permit the release of large amounts of well fluids. Conventional well control safety valves are located in the upper portion of the well. Normally in offshore wells the safety valve will be mounted a short distance below the ocean bottom. Such downhole safety valves typically include ball type or flapper type valves which are opened or closed by applying or releasing pressure at the surface to control fluid in a separate control line extending to the surface of the well. A rupture of this separate control line will reduce the pressure acting to keep the safety valve open thus permitting the ball or flapper to close and shut off the well.

One problem with positioning a safety valve above exposed tubing is that the integrity of the well depends not only upon the safety valve but also upon the integrity of the tubing extending from the safety valve to the packer, which would normally be located in the vicinity of the producing zone. Thus if any leaks develop in the tubing between the packer and the safety valve these leaks will result in the escape of fluids from the tubing to the tubing-casing annulus. This invention presents a solution to this problem since the safety valve is mounted in or below the packer thus isolating the tubing above the packer from the formation fluid.

It is also a conventional practice in either safety valves or other downhole oil tools to use a dome charge or gas pressure chamber as part of the actuating mechanism of the tool. Often it is impossible to use a spring with a sufficient strength to balance hydraulic or other forces acting on some actuating member in the tool. It is conventional to use a gas at high pressure to provide forces greater than those which can be developed with a mechanical spring. These gas actuated tools are commonly referred to as dome charge tools, and the chamber containing the gas at an elevated pressure is referred to as a dome charge chamber or reference pressure chamber. The converse of this situation is a tool which uses a low-pressure or atmospheric pressure chamber into which a piston or other actuating member extends. Such a low pressure or atmospheric pressure chamber provides a known reference against which differential forces acting through the piston can be created. Unfortunately, both dome pressure charges and atmospheric pressure chambers have proved unreliable since it has been difficult to prevent leakage of the gas contained in the chamber or in formation fluids past seals in the tool. Thus the constant reference pressure desired cannot be maintained over time.

One possible solution to this problem is to provide a barrier fluid in the vicinity of elastomeric seals to prevent the passage of the gas past the seals. This solution was suggested in U.S. Pat. No. 3,561,473. This device employed a chamber containing a liquid such as silicon oil which would be relatively impervious to the passage of a gas in an atmospheric pressure chamber. Seals were located between the barrier fluid chamber and the atmospheric chamber. The seal would prevent leakage of the oil or barrier fluid into the atmospheric pressure chamber and the barrier fluid would prevent leakage of the gas through the barrier fluid chamber, thus maintaining the atmospheric pressure at a constant pressure. Although this tool would be effective to improve the performance of a tool containing an atmospheric pressure chamber, some leakage would still be possible. This arrangement would not be expected to perform as satisfactorily when a high pressure or dome charge is employed, since the high pressure gas after passing through intermediate elastomeric seals would tend to move through the barrier fluid to a region of lower pressure.

SUMMARY OF THE INVENTION

A subterranean well tool, such as a subsurface safety valve assembly comprising the preferred embodiment of this invention, utilizes a reciprocal member, such as a piston, which is exposed to different pressure forces on opposite ends. The piston acts against the reference pressure force generated by a dome charge comprising a pressurized gas contained within a reference pressure chamber. A barrier fluid, relatively impervious or impermeable to the passage of gas therethrough, is provided between the reference pressure chamber and a region, such as the tubing-casing annulus, at which a different pressure exists. This barrier fluid is at a pressure in excess of the pressure in the reference pressure chamber to further retard passage of gas, against an increasing pressure, through the barrier fluid. In the preferred embodiment of this invention the increased pressure of the barrier fluid is generated by the use of a spring loaded member acting on the barrier fluid contained in a separate cavity. When used in conjunction with resilient seals to prevent the passage of liquids, this pressurized barrier fluid would significantly increase the stability of reference pressure chambers, by preventing migration of gas into or out of the reference pressure chamber.

This reference pressure chamber and barrier fluid chamber is, in the preferred embodiment of this invention, incorporated into a subsurface control used to actuate a safety valve which opens and closes the tubing. The safety valve in the preferred embodiment is mounted in the packer, below the seals between the tubing and the packer. The subsurface control, which is used to actuate the safety valve, is controlled by variations in annulus pressure and the pressure differential between the annulus pressure and the reference pressure in the dome charge cavity. This reference pressure is initially set equal to the annulus pressure by using a floating piston to alter the volume of the reference pressure chamber as the tool is lowered into the well and by using a locking means to prevent further movement of the floating piston. Thereafter variations in annulus pressure, controlled by a surface unit, will cause movement of a piston within the subsurface contol. An initial increase in the annulus pressure will cause the safety valve to be opened, but a further increase or a reduction in annulus pressure will cause the valve to close.

BRIEF DESCRIPTION OF THE DRAWINGS

FIG. 5 consisting of continuations.

DESCRIPTION OF THE PREFERRED EMBODIMENTS

Figure 1:
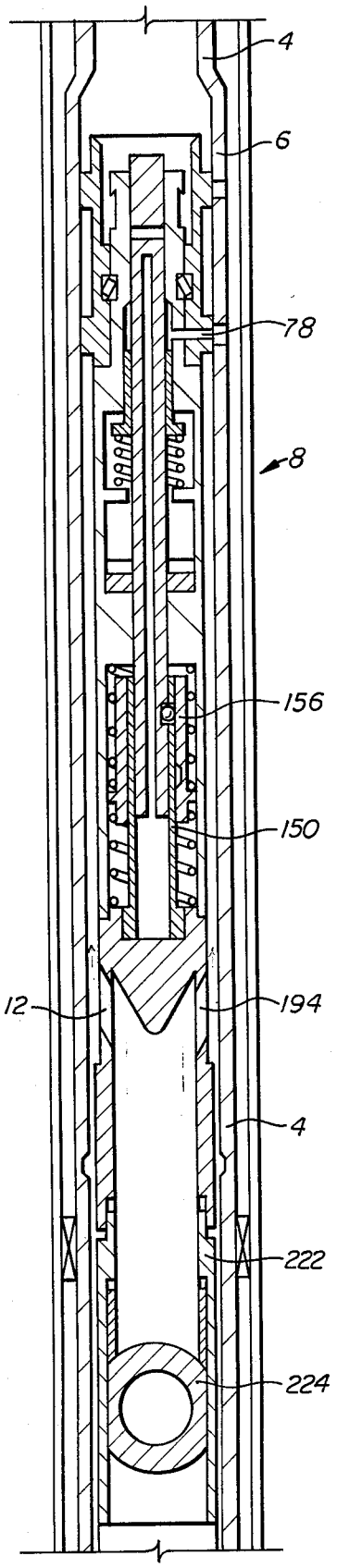
FIG. 1 is a schematic showing the safety valve in its initial closed position.
Figure 2:
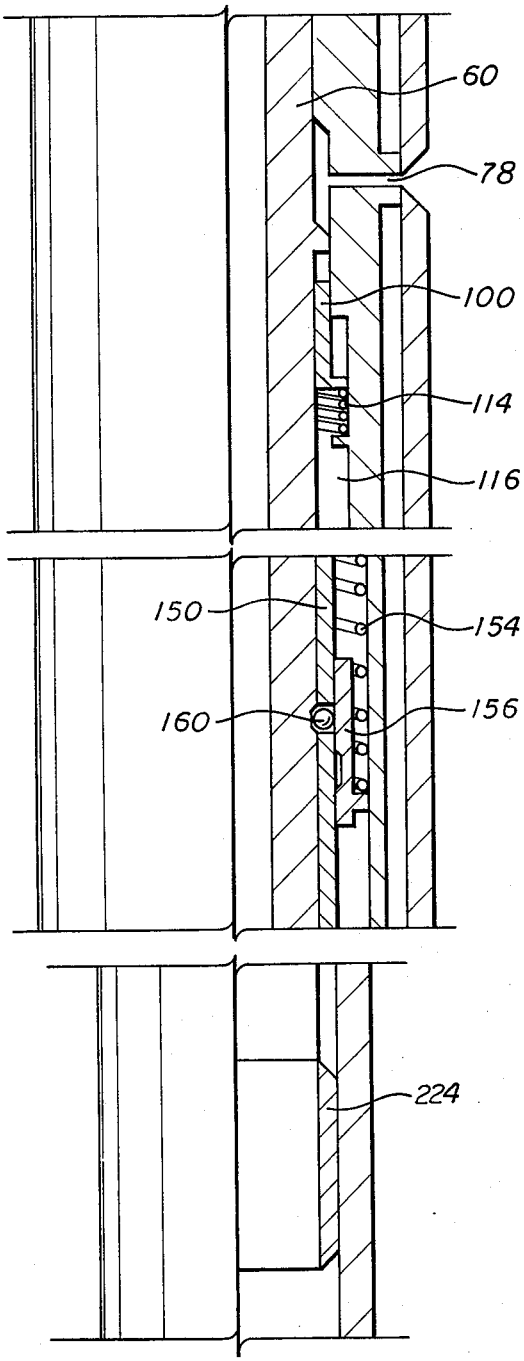
FIG. 2 is a schematic showing the valve in its open position as annulus pressure acts upon the control unit.
Figure 3:
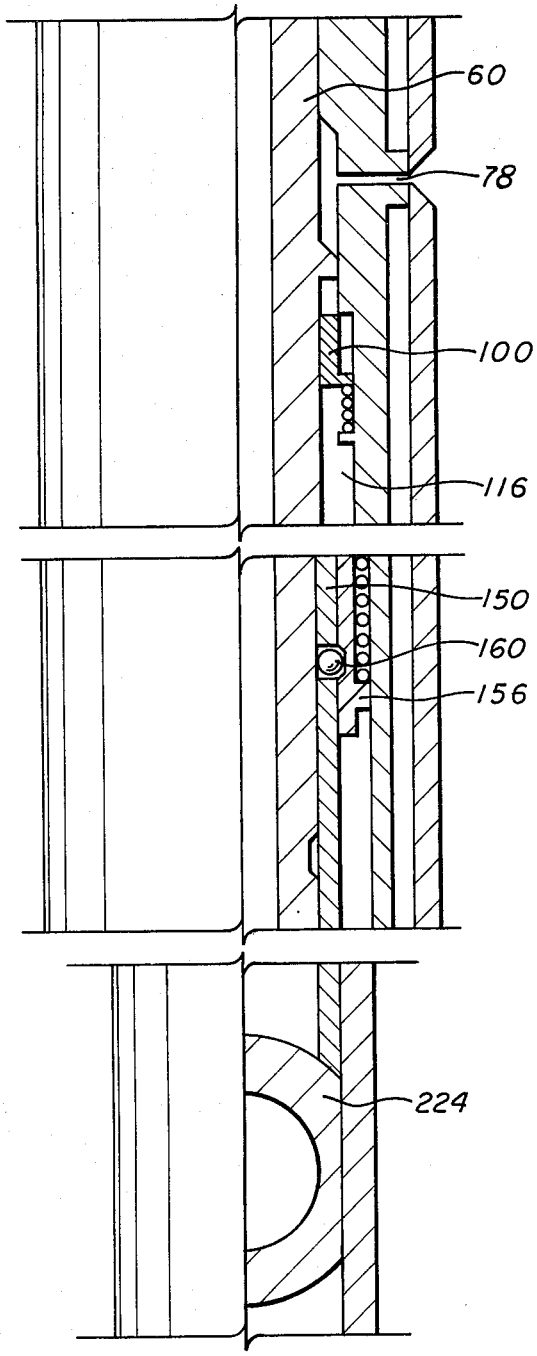
FIG. 3 is a schematic showing the valve in its closed position after partial retraction of the actuating mechanism.
Figure 4:
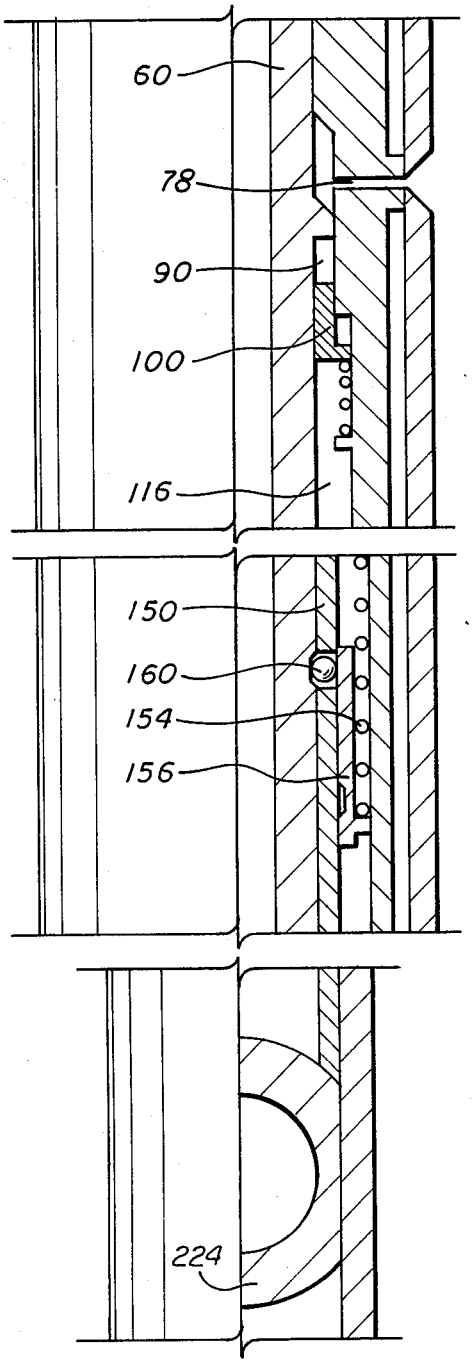
FIG. 4 is a schematic of the valve in its closed position after complete retraction of the actuating piston.

The safety valve system comprising the preferred embodiment of this invention consists of four major components. These major components are: a wireline retrievable safety valve 16; a wireline retrievable subsurface control unit 8; a well packer 18 which receives the safety valve 16; and a surface control (not shown) that will maintain annulus pressure at a desired operating level, monitor and control the level of fluid in the tubing-casing annulus, and be capable of dumping annulus pressure when signaled to do so.

The relative orientation of the three downhole components of this valve system is depicted in schematic form in FIGS. 1–4. The detailed construction is shown in FIG. 5. The safety valve 16 is mounted in a well packer 18 of substantially conventional construction. The well packer 18 engages the interior of the casing of the well. The separate subsurface control 8 is located above the safety valve 16 but it is not directly supported by either safety valve 16 or packer 18. A by-pass landing nipple 6 is incorporated into the fluid transmission conduit or tubing string 4 adjacent its lower end. The subsurface control 8 is in turn held (or locked) in by-pass landing nipple 6 by means of an appropriate lock 11. A production tube 12 extends from the lower portion of surface control 8 to abut an actuating pivot arm located in safety valve 16. This actuating pivot arm 222 is attached to safety valve head 224, and upon movement of production tube 12 and pivot arm 222 the safety valve head 224 can be moved from the closed position shown in FIG. 1 to the open position shown in FIG. 2.

FIGS. 1–4 are schematic in nature and are intended to illustrate only the orientation and operation of the valve and separate subsurface control. These schematic representations are in no way intended to represent the detail construction of either the valve, the subsurface control, or the packer. FIGS. 5*a*–5*g*, each representing the downward continuation of the previous figure, do show the detail construction of the components of the preferred embodiment of this invention. The relative position of the components as shown in FIGS. 5*a*–5*g* is consistent with the position of these components prior to actuation of either the safety valve or the subsurface control in the well.

Figure 5A:
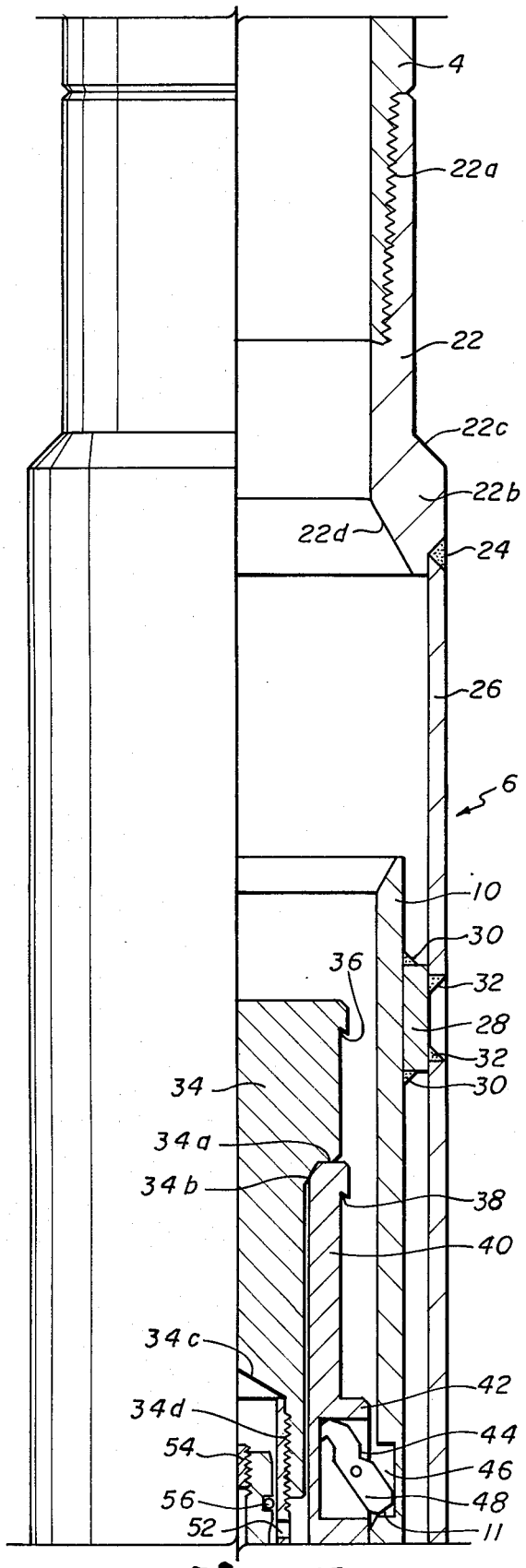
FIG. 5*a*–5*h* is an elevational view of the valve and control employed to the preferred embodiment of this invention.

The positioning of the subsurface control unit 8 in the by-pass landing nipple 6 is shown in FIG. 5*a*. The by-pass landing nipple is incorporated into the tubing string 4 within casing 2 by means of a by-pass landing nipple coupling 22 located at its upper end. Coupling threads 22*a* engage conventional threads on the bottom of the lowermost element in the tubing string 4. Coupling member 22 has an enlarged base 22*b* with inclined outer surface 22*c* and inclined inner surface 22*d* which effectively increases the internal bore over that of the tubing string. Coupling member 22 is attached to the outer housing 26 of the by-pass landing nipple by means of a weld 24. An inner concentric control nipple 10 is attached to the outer housing 26 by means of a plurality of lugs 28 located around the circumference of the inner concentric control nipple 10. Each lug is welded to the inner nipple 10 by means of welds 30 and is welded to the outer housing 26 by means of welds 32.

The wireline retrievable subsurface control unit 8 is mounted on the inner concentric control nipple 10 by means of a conventional locking mechanism 11. This lock has a plurality of locking dogs 48 located in locking cavities 44 which can be expanded radially outward to engage locking recesses or grooves 46 located on the interior of the inner concentric control nipple 10. The radially expandable locking dogs 48 are mounted in a lock housing 40 located adjacent the upper end of control unit 8. Lock housing 40 has a downwardly facing outer shoulder 38, useful in fishing and retrieving operations, located at its upper peripheral end.

A seal sleeve retrieving neck 34 is positioned on the interior of lock housing 40 and a downwardly facing shoulder 34*a* on the exterior of the seal sleeve retrieving neck abuts a cooperating shoulder on the lock housing. These cooperating shoulders consist of an inwardly extending radial surface 34*a* and an inclined adjacent surface 34*b*. The retrieving or fishing neck 34 is connected to a cylindrical seal sleeve 50 adjacent its lower end by means of threads 34*d* and neck 34 has shoulder 36 at its upper end useful for actuating seal sleeve 50. Seal sleeve 50 abuts the upper end of a counterbore 34*c* and extends downwardly from a fishing neck 34. Seal sleeve 50 has a port 52 extending radially therethrough immediately below the threaded connection at 34*d*. Immediately below port 52, seal sleeve 50 has an inwardly inclined and upwardly facing surface 50*a*. An annular groove 62 is located along the exterior surface of seal sleeve 50 and spaced from port 52. Annular locking groove 62 is flanked by an upper and lower shoulder 62*a* and 62*b*. A shear block 66 is shear pinned to seal sleeve 50 by means of pin 64 along the exterior of the seal sleeve and immediately below annular groove 62.

Lock housing 40 which extends concentrically around seal sleeve 50 is attached at its lower inner end to port sub 74 by means of conventional threads 74*a*. Port sub 74 comprises a generally cylindrical member which is concentric with and spaced from the lower portion of seal sleeve 50 in the configuration of FIGS. 5*a* and 5*b*. Port sub 74 has a seal retaining receptacle 74*d* located along its external surface immediately below threads 74*a*. This cavity 74*d* receives a conventional packing element or seal stack 76. This conventional seal stack may include chevron shaped elastomeric sealing elements together with back-up members to prevent axial extrusion of the sealing element. An upwardly facing shoulder 74*f* is located on the inner surface of port sub 74 immediately adjacent its upper end and on the opposite face relative to threads 74*a*. This shoulder merges with a longitudinally extending inner surface 74*g* which is spaced from seal sleeve 50. A second shoulder 74*e* extends from longitudinally extending surface 74*g* below the lower end of seal sleeve 50. An O-ring seal 88 is located immediately below surface 74*e* along an inner surface of port sub 74. An inclined downwardly facing surface 74*h* is located immediately below O-ring seal 88 and defines the upper surface of an annulus pressure actuating cavity 98. A port 78 extends radially through port sub 74 and enters pressure actuating cavity 98 immediately below upper surface 74*h*. Port 78 is located adjacent to lower end of port sub 74. A threaded section 74*c* extends from the lower outer end of the port sub to provide a threaded connection 74*b* with the upper cylinder head 96 which abuts the lower end of the port sub.

Upper cylinder head 96 has a recess for retaining a packing element or seal stack 92 generally equivalent to the seal stack 76. Upper cylinder head 96 comprises a generally cylindrical and symmetrical member having threads 96*a* adjacent its lower outer end similar to the threaded connection 74*b* with the port sub. Seal elements 76 and 92 engage the inner surface of the inner concentric nipple end attached to by-pass landing nipple 6. These sealing elements isolate a longitudinally extending cavity 75 located between the port sub 74 and the inner concentric nipple 10. A port 77, generally in alignment with port 78 extends through nipple member 10 and communicates with cavity 75. A lug 82 also having an aligned port is welded at 84 and 96 to both the inner and outer nipple members 10 and 6 respectively. A port 80 opening through by-pass landing nipple 6 provides communication between the pressure actuating cavity 98, the subsurface control 8 through aligned ports 77 and 78 and the tubing-casing annulus.

A lock mechanism comprising an outer lock ring housing 70 and inner lock ring segments 68 is positioned between seal sleeve 50 and port sub 74 adjacent the upper end of port sub 74. The lock ring housing 70 has recessed faces on its inner periphery with an upwardly facing inclined surface 70*b* extending generally from the lower portion of the lock ring housing. An annular downwardly facing shoulder 70*a* extends around the outer surface of the lock ring housing intermediate its upper and lower ends. This downwardly facing shoulder 70*a* is positioned in abutting relationship to a cooperating upwardly facing shoulder 74*f* on the port sub 74. Lock ring segments 68 is positioned on the inner face of the lock ring housing 70. Each segment 78 has a downwardly facing inclined surface 68*b* cooperable with the inclined surface 70*b* on the lock ring housing. A retaining ring 72 biases the lock ring segments inwardly, and as shown in FIG. 5*a* the lock ring segments are in contact with the outer surface of the seal sleeve 50. Each lock ring segment 68 has an upwardly facing shoulder 68*a* located along its upper end which is formed by a cutout along the inner surface of the lock ring segment.

A longitudinally extending control piston 60 extends along substantially the entire length of the subsurface control 8. This longitudinally extending piston is in contact along its inner surface with seal sleeve 50 adjacent the piston's upper end. Piston 60 has a threaded upper inner end receiving a threaded cap member 54. An O-ring seal 56, disengaged in the configuration shown in FIG. 5*a* is located along the outer surface of piston 60. Immediately below seal 56 a port 58 extends through control piston 60. In the configuration of FIG. 5*a* there is communication between port 58 and the port 52 in the seal sleeve. The piston 60 has an inner counterbore extending along substantially its entire length. Port 58 permits communication from the exterior of piston 60 to this counterbore 60*a*. Piston 60 is in contact with the outwardly adjacent seal sleeve along substantially the entire length of this seal sleeve 50. Immediately below seal sleeve 50 the piston contacts the port sub 74 with rod seal 88 providing sealing integrity between the port sub 74 and the piston 60. The outer surface of piston 60 defines the inner surface of pressure actuating cavity 98 between rod seal 88 and piston seal 94 located in a groove along the inner surface of piston 60. Piston seal 94 provides sealing integrity at the lower end of pressure actuating cavity 98 and is in contact with the inner surface of upper cylinder head 96. A downwardly facing shoulder 60*e* is located below piston seal 94 and merges with a longitudinally extending surface 60*f*. This surface 60*f* is spaced from the inner surface of upper cylinder head 96 and defines a barrier fluid cavity 90 between the piston and upper cylinder head. Another O-ring seal 102 is located below barrier fluid cavity 90 and provides sealing integrity between piston 60 and a longitudinally extending booster sleeve 100. A downwardly facing inclined surface 60*g* is located below O-ring seal 102 and provides radially spacing between the outer surface of piston 60 and the inner surface of booster sleeve 100. A threaded connection is formed between the upper section 60*b* and the middle 60*c* of piston 60 at a point below the location of shoulder 60*g*. The middle section 60*c* comprises a generally cylindrical member having a port 132 located generally adjacent the bottom end of inner counter bore 60*a*. Port 132 provides communication between the inner counter bore 60*a* and a cavity 140 located between the outer surface of the middle piston section 60*a* and an inner surface of lower cylinder head 136. A retaining ring 138 is positioned within a cooperating groove along the outer surface of middle piston section 60*a* immediately below port 132 in the cavity 140.

Figure 5B:
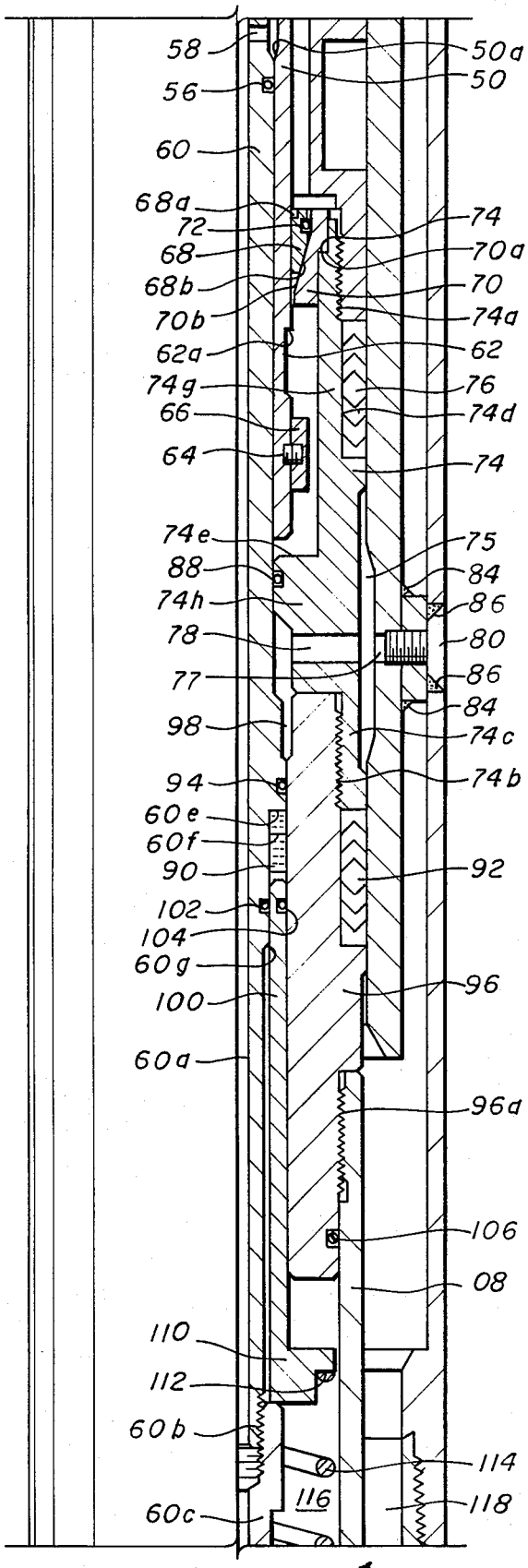

The cylindrical booster sleeve 100 extends between piston 60 and upper cylinder head 96 immediately below barrier fluid cavity 90. O-ring seal 102 provides sealing integrity between the exterior surface of the piston 60 and the interior surface of booster sleeve 100. A similar O-ring seal 104 provides sealing integrity between the outer surface of the booster sleeve and the inner surface of cylinder head 96. A liquid such as an oil substantially impermeable to a gas such as nitrogen is trapped in the cavity 90 between piston 60, booster sleeve 100 and upper cylinder head 96. Below O-ring seal 102 the interior surface of booster sleeve 100 is spaced from the exterior surface of piston 60. Booster sleeve 100 extends into a dome charge or reference pressure chamber 116 located between piston 60 and spring cylinder 108 below upper cylinder head 96. The enlarged booster sleeve base 110 abutts the upper surface of the middle piston section 60*c* as shown in FIG. 5*b*. Base 110 provides a downwardly facing abutting shoulder 112 for engaging a primary coil spring 114 in reference pressure chamber 116. Primary spring 114 extends between the base of booster sleeve 110 and a spring retainer 120. Spring retainer 120 has an upwardly facing retaining shoulder 122 for engaging primary spring 114. Spring retainer 120 engages an annular ring 123 on the interior of spring cylinder 108. Spring cylinder 108 extends between upper cylinder head 96 and lower cylinder head 136 and is attached to each by means of conventional threaded connections. An O-ring seal 134 is positioned between the upper portion of the lower cylinder head 136 and the threaded connection 136*a* between the lower cylinder head and the spring cylinder 108.

A floating piston 126 is located between the outer surface of middle piston section 60*c* and the inner surface of spring cylinder 108. O-ring seals 128 are located on the inner and outer surfaces of floating piston 126. Floating piston 126 is free to move with respect to both the piston 60 and spring cylinder 108. In the configuration shown in FIG. 5*c* the floating piston 126 is in abutting relationship with the upper end of lower cylinder head 136. Floating piston 126 comprises the lower surface of reference pressure chamber 116 and movement of this floating piston will change the volume of that reference pressure chamber and will consequently change the pressure of the gas contained therein. A barrier fluid 124, such as an oil impermeable to the nitrogen normally contained within the reference pressure chamber has settled due to gravity along the upper surface of floating piston 126. This barrier fluid will normally be the same fluid used in barrier fluid cavity 90 adjacent the upper end of booster sleeve 100. Note that pressure in cavity 140 will act on the lower surface of floating piston 126 and movement of piston 126 will serve to equalize the pressure in cavity 140 with the pressure in the reference pressure chamber.

Figure 5C:
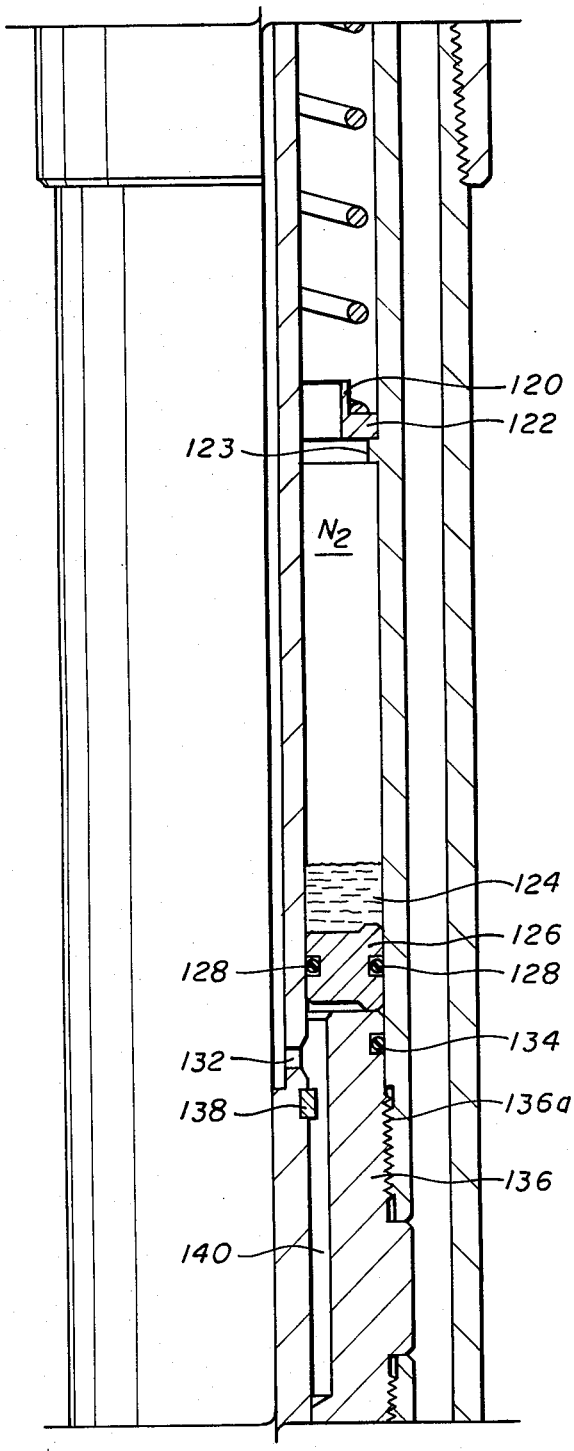
Figure 5D:
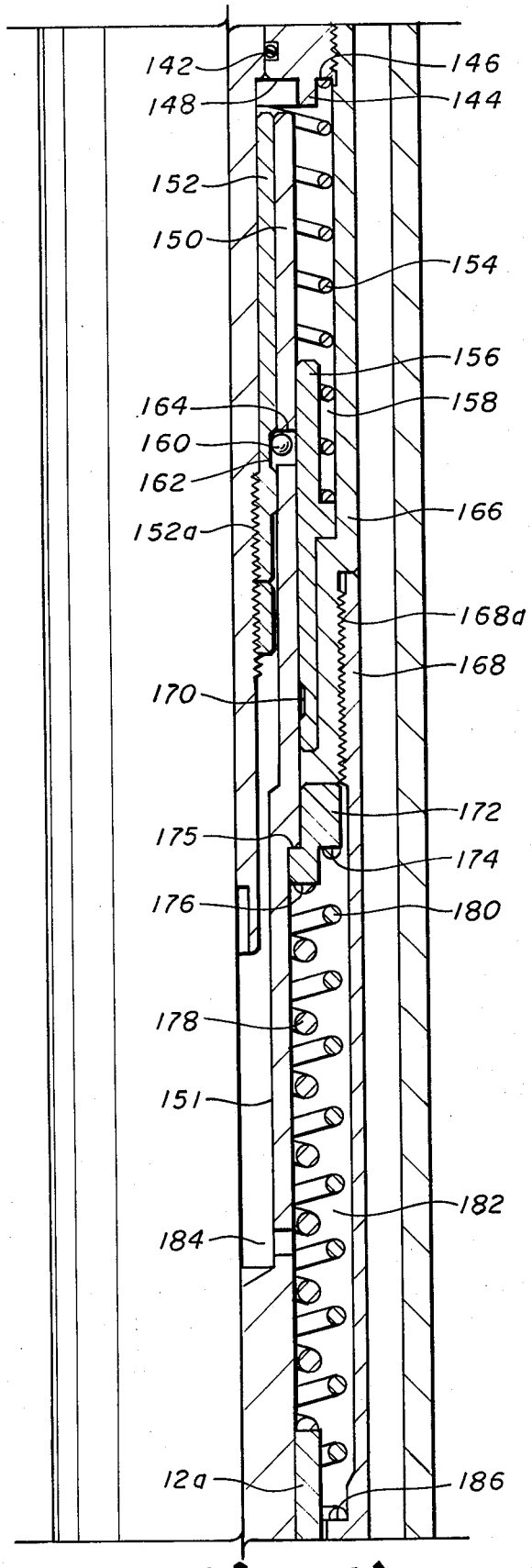
Figure 5E:
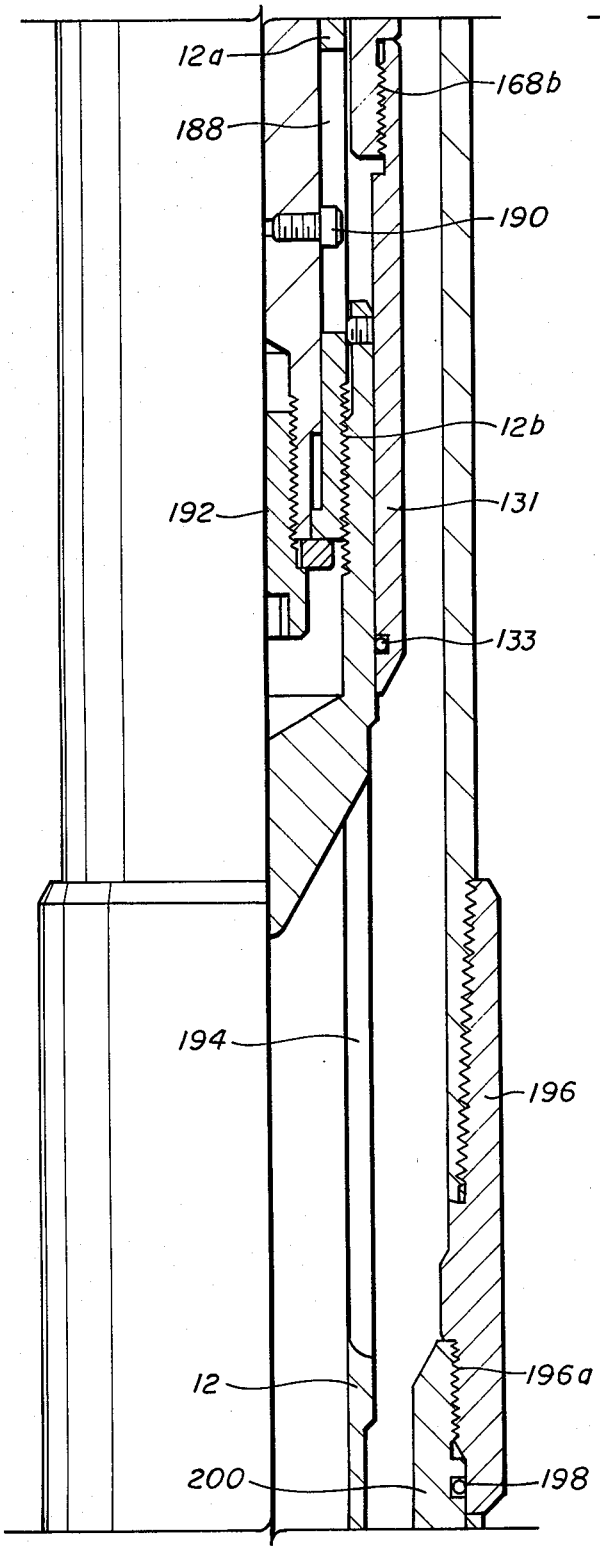
Figure 5F:
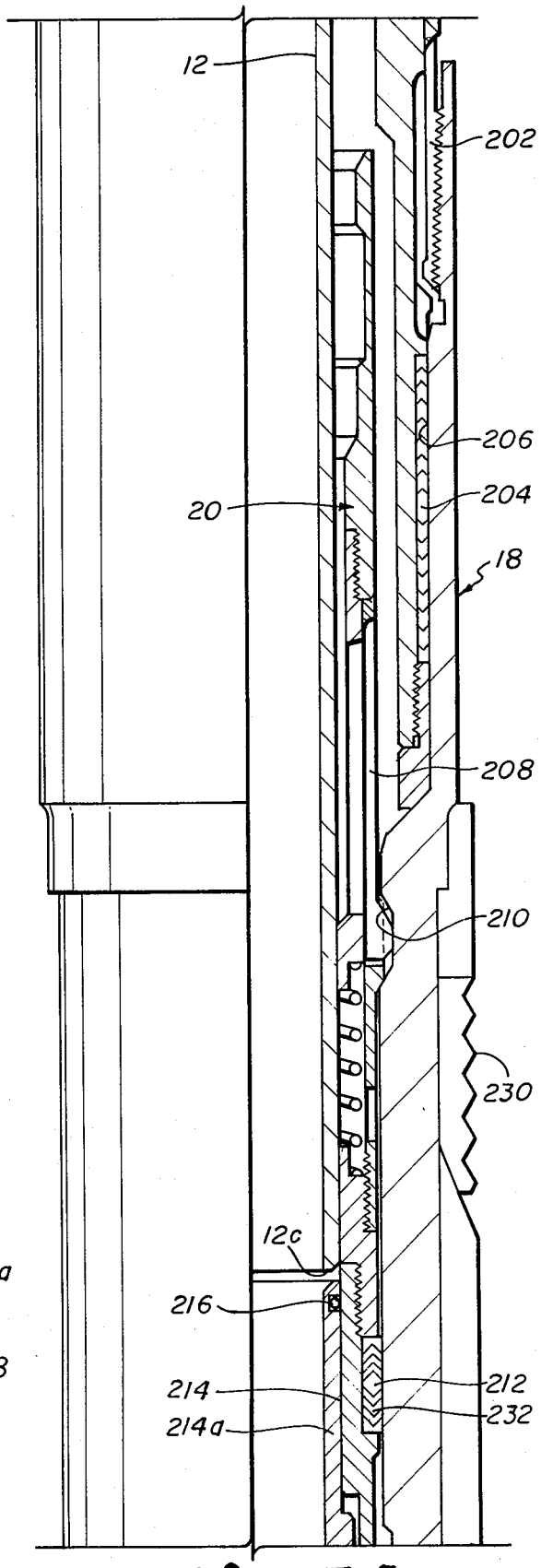
Figure 5G:
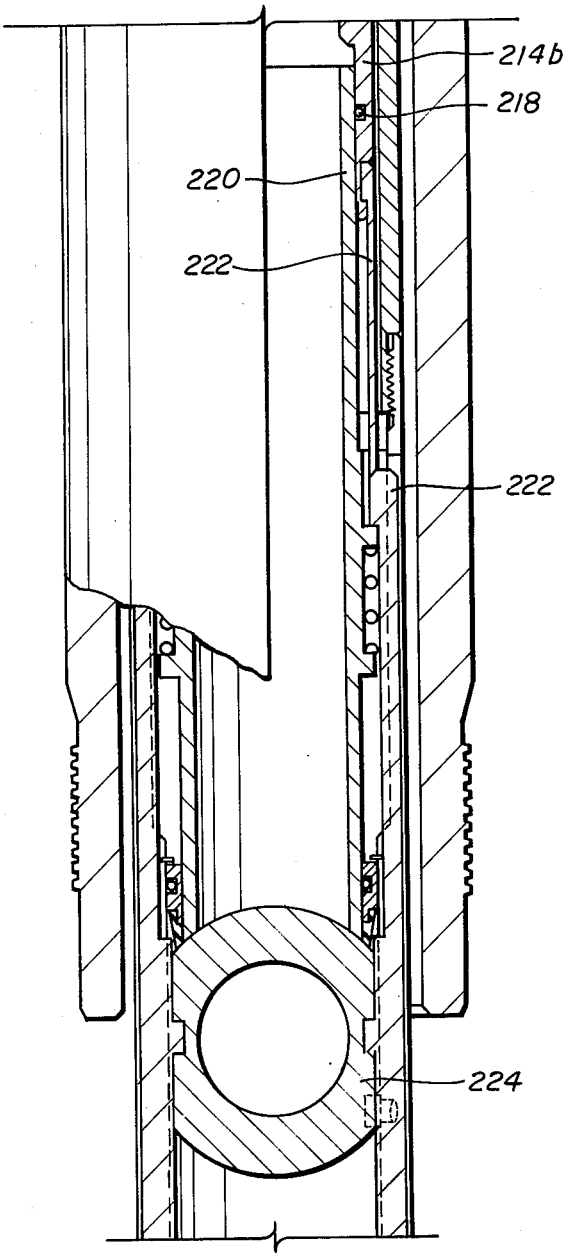
Figure 5H:
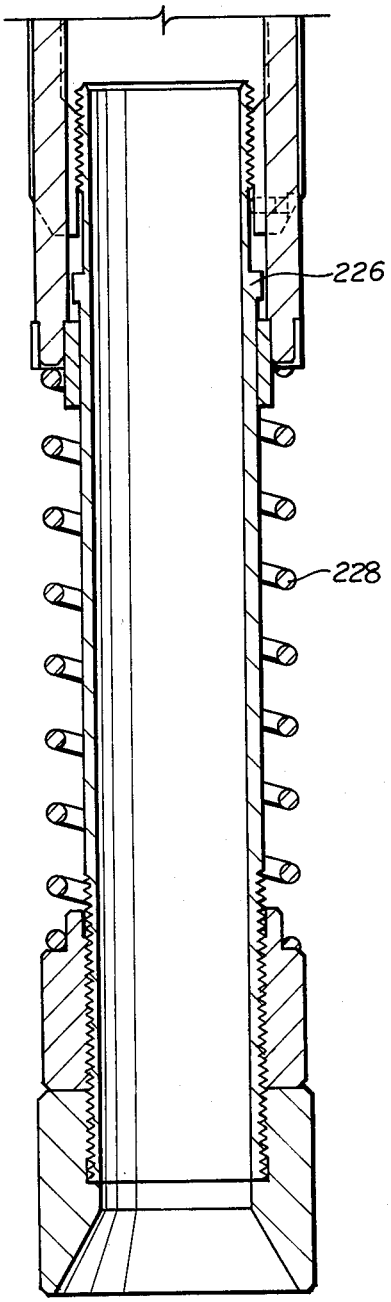

Lower cylinder head 136 is attached at its upper end to spring cylinder 108 and at its lower end to release sleeve housing 130. This inner connection is by means of a conventional threaded connection. Release sleeve housing 130 has an offset lower section forming a threaded connection 168*a* with lower spring cylinder 168. Lower spring cylinder 168 has a threaded connection 168*b* with a cylindrical sealing extension 131 (FIG. 5E). This sealing extension has an O-ring seal 133 at its lower inner end.

Lower spring cylinder 168 is concentric with and spaced from piston 60. A plurality of springs and sleeve members are located between the piston 60 and the generally co-linear release sleeve housing 130 and lower spring cylinder 168. A thrust sleeve 152 is attached by means of threaded connection 152*a* to the middle piston section 160. Thrust sleeve 152 has an annular recess or groove 162 located on its inner surface. A thrust mandrel 150 extends concentrically with and immediately adjacent thrust sleeve 152. This longitudinally extending thrust mandrel extends below and beyond both the thrust mandrel 152 and the piston 60. In the configuration shown in FIG. 5*c* the thrust mandrel 150 has a radially extending opening positioned immediately adjacent thrust sleeve groove 162. A steel ball 160 is trapped in recess 162 and opening 164 thus holding thrust sleeve 152 in engagement with thrust mandrel 150. Thrust mandrel 150 has an inner counter-bore 151 which receives the lower end piston 60. A port 184 provides communication between this counter-bore and the spring cavity 182 located adjacent the exterior of thrust mandrel 150. Below port 184 a torque pin 190 having an enlarged head located on the exterior of the thrust mandrel is threadably attached to the thrust mandrel. This enlarged head 190 is received within a longitudinally extending slot 188 in the upper section 12*a* of a production tube assembly 12.

A release sleeve 156 is located along the outer surface of thrust mandrel 150. The inner surface of release sleeve 156, as shown in FIG. 5*c* holds the steel ball or balls 160 in the aligned recesses and openings 162 and 164. Release sleeve 156 is spring biased relative to the lower cylinder head 136 by a release sleeve spring 158. Release sleeve spring 158 extends between the bottom surface 146 of the lower cylinder head and a radial projection 166 on the exterior of release sleeve 156. An annular groove 170 is located along the lower interior surface of release sleeve 156. This groove 170 is similar to groove 162 located on thrust sleeve 152. Groove 170 is however spaced from the location of groove 162 and the steel ball 160 contained therein when the subsurface control 8 is in the position shown in FIG. 5*c*.

A thrust mandrel bushing 172 is located adjacent the exterior surface of thrust mandrel 150 below release sleeve 156. Bushing 172 has a stepped lower surface consisting of sections 174 and 176. A upwardly facing shoulder 175 on the inner surface of the bushing 172 engages a cooperating shoulder on the exterior of the thrust mandrel 150. In the configuration shown in FIG. 5*d* the bushing 172 abutts the lower end of release sleeve housing 130. Obviously the thrust bushing 172 is at the upper extent of its travel when the subsurface control 8 is in the configuration shown in FIG. 5*c* and *d*. A spring cavity 182, in which bushing 172 is free to move is defined between thrust mandrel 150 and lower spring cylinder 168. This spring cavity 182 contains two adjacent and concentric coil springs 178 and 180. Both springs abut the lower facing surfaces of bushing 172. The lower end of the inner spring abutts the upper surface of the production tube extension 12*a* at the lower end of the spring cavity. The outer spring 180 abuts an upwardly facing surface 186 adjacent the lower inner end of lower spring cylinder 168. The spring force exerted by auxiliary spring 178 and secondary spring 180 will be greater than the force exerted by release sleeve spring 154. Auxiliary spring 178 serves to bias the thrust mandrel 150 relative to production tube 12, which is held in its position in FIG. 5*d* by means of an abutting shoulder adjacent the lower end of the thrust mandrel. The secondary spring 180 serves to bias the thrust mandrel 150 relative to the outer spring cylinder 168 which forms a portion of the outer housing of the subsurface control 8 extending generally along its entire length.

Production tube assembly 12 is attached to the lower end of the thrust mandrel 150 and extends from the lower end of the subsurface control 8 to the safety valve 16 mounted in the permanent packer 18 located below the subsurface control. Production tube 12 has a flow port 194 located below the lower end of the subsurface control 8 to permit flow in the production tube to by-pass the subsurface control. Note that production tube 12 is not connected to the packer mounted safety valve 16 but the lower end of production tube 12 is located immediately above actuating sleeve 214 in the safety valve. Downward movement of the production tube 12 will serve to actuate this safety valve.

The by-pass landing nipple 6 extends generally around the subsurface control unit 8 and is generally concentric with the production tube 12 in the vicinity of flow port 194. A flow by-pass channel 118 communicates with flow port 194 and permits flow between the subsurface control unit and the outer by-pass landing nipple 6. The lower end of the by-pass landing nipple 6 is attached to the upper end of a packer 18 by means of an anchor latch-nipple coupling 196. Conventional threads 196*a* and an O-ring 198 provide a threaded and sealed connection with the by-pass landing nipple. The anchor latch assembly extending between the by-pass landing nipple and the packer is of generally conventional construction and has a latch 202 for engaging the threads on the upper end of the packer body. A generally conventional seal stack 204 is located along the exterior of the anchor seal assembly and provides sealing integrity with the seal bore receptacle 206 on the interior of the packer body. As shown, the by-pass landing nipple is attached to the packer but there is no direct connection between the subsurface control or production tube and either the packer 18 or the safety valve 16.

The wireline retrievable safety valve 16 is attached to the packer bore by means of a generally conventional lock mechanism 20. This lock has a radially expandable collet 208 engagable with a cooperating recess 210 formed on the interior of the bore of the packer. This lock may be set and released in a conventional manner. A seal is provided between the lock 20 and the interior bore of the packer by means of conventional packing 212. The packer 18 can be affixed to the exterior casing by means of conventional slips and packing elements.

The safety valve itself employs a rotating ball valve head 224 containing a fluid passage therethrough. In the configuration shown in FIG. 5*g* the fluid passage extends perpendicular to the flow tube of the safety valve thus preventing flow therethrough. Rotation of ball valve head 224 results upon longitudinal movement of pivot arm 222. The ball valve head 224 is attached to this longitudinal movable pivot arm in a conventional fashion. Pivot arm 222 is in turn attached to a valve actuating sleeve 214. Valve actuating sleeve 214 though attached to pivot arm 222 is not attached to production tube 12. The valve actuating sleeve 214 is however positioned immediately below the lower end of the production tube 12. Downward movement of the production tube will cause downward movement of the actuating sleeve 214 to open the valve. O-ring seals 216 and 218 respectively provide sealing integrity with the lock 20 and with a longitudinally extending valve seat 220 respectively. This valve seat has a seal contact with the exterior surface of spherical ball valve head 224. As the ball valve head 224 is rotated upon longitudinal movement of both the pivot arm and of the ball valve head itself, the ball valve head will come in contact with spring guide 226 which has a spring member 228 which serves to urge the ball 222 upward as it is closed.

OPERATION

As described this packer depth-annulus pressure controlled safety valve system has four major components. These components are: the wireline retrievable safety valve 16, the wireline retrievable subsurface control 8 which is insensitive to tubing pressure but responsive to annulus pressure; a permanent type packer 18 which receives a safety valve; and a surface control (not shown) that will maintain annulus pressure at a prescribed operating figure and will monitor and control the annulus fluid level. The surface control will be capable of dumping annulus pressure upon receipt of an appropriate signal.

In this system the safety valve is normally closed. It is opened by applying a predetermined pressure at the surface to the fluid in the tubing-casing annulus. The valve will remain open until an upper limit of pressure is exceeded and then it will close. The valve may also be closed by bleeding off annulus pressure at the surface. The valve can then be considered a "fail-safe" valve. For example, if an excessive tubing leak develops which increases annulus pressure to an undesirable level, the valve will close. If damage at the well head causes the loss of the imposed annulus pressure, the safety valve will also close.

The safety valve and control assembly is received by a packer 18 initially positioned within the well. In many respects safety valve 16 is a conventional ball type safety valve. However this safety valve is adapted to be received within the bore of packer 18 as already described. Safety valve 16 is actuated by means of longitudinal movement of production tube 12 which is attached to the subsurface control located above safety valve 16. The control 8 is in turn attached to the tubing 4 which extends upwardly toward the surface of the well.

The safety valve 16 shown here positioned in the packer would normally be run through the tubing on a wireline and latched in place in packer 18. After the tubing has been landed in the packer and preferably before installing safety valve 16, drilling fluid in the tubing and annulus would be displaced with a completion fluid. This can be done through the ports in the by-pass landing nipple 6, through a sliding sleeve valve or by other conventional techniques. If the well has been perforated, the safety valve 16 could be installed and any pressure held in the annulus would be bled off. Since the density of the completion fluid is known, the static bottomhole pressure can be calculated.

Subsurface control 8 can be positioned in by-pass landing nipple 6 by running the subsurface control in on a wireline until locks engage in the nipple lock recesses. Appropriate spring characteristics are provided in the subsurface control 8 by using a compressed nitrogen or dome charge contained in reference pressure chamber 116. Movement of piston 60 for actuation of safety valve 16 is caused by the differential forces exerted on piston 60. These differential forces are due to changes in annulus pressure acting through port 80 and on an upper control piston surface in annulus pressure actuating cavity 98. The force acting on control piston 60 in the opposite direction is due largely to the pressure established in reference pressure chamber 116. Initially this reference pressure will not be equal to the well hydrostatic pressure at the location of landing nipple 6 and subsurface control 8. It is desirable however to charge the nitrogen in the reference pressure chamber so that this pressure will be equal to the well hydrostatic pressure. After the pressure in the reference pressure member is set in this manner, it should remain constant until movement of the piston 60 causes a decrease in volume and subsequent increase in pressure. Therefore the pressure in the reference pressure chamber will be a function of the position of piston 60. The differential annulus pressure necessary to actuate the valve can then be applied at the surface and will not have to be altered by the initial difference between the nitrogen pressure and the well hydrostatic pressure. Although the well hydrostatic can be estimated fairly closely, it is difficult to charge a dome or reference pressure chamber to the exact pressure chamber desired during operation. The pressure may be excessive and make handling on the surface difficult and in addition there must be compensation for the effect of bottomhole temperature. This subsurface control 8 has a built-in mechanism for increasing the initial nitrogen charge to the value of the bottomhole hydrostatic pressure as the control is lowered into the well. This charged pressure is then captured in the reference pressure chamber when the control is landed in the by-pass landing nipple 6 and will provide a constant reference for operation of subsurface control 12. Charging of the reference chamber 116 during insertion of the subsurface control occurs because annulus fluid can communicate through ports 52 and 58 to the passageway 60*a* in the control piston.

Annulus pressure then acts through port 132 on the lower surface of floating piston 126. Being free to move longitudinally in reference pressure chamber 116, floating piston 126 will move upward and further compress the nitrogen in reference pressure chamber 116 until its pressure is equal to the hydrostatic pressure at the tool. This reference pressure is locked in when the wire line running tool which engages fishing neck 36 is released. This action moves the seal sleeve retaining neck 34 upward. Upward movement will cause seal sleeve 50 to move such that O-rings 56 will engage the inner surface of seal sleeve 50 and communication between ports 52 and 58 will be prevented. Lock ring segments 68 will engage recesses 62 to lock the seal sleeve in place. In this locked configuration the annulus pressure in passageway 60*a* and acting on the lower surface of floating piston 126 will remain constant and equal to the gaseous pressure in reference chamber 116 acting on the upper surface of floating piston 126. However, subsequent increases in tubing-casing annulus pressure will act on piston 60*a* causing a differential force due to the change in annulus pressure.

A barrier fluid generally impervious to the passage of gas therethrough can be employed to prevent leakage of nitrogen or other gas contained in reference pressure chamber 116. Any liquid which would tend to retard the passage of the pressurized gas could be used. For example, an oil or water might be used as a barrier fluid. A small amount of this barrier fluid can be placed in the reference pressure chamber 116 so that the barrier fluid will collect under the action of gravity on the upper surface of floating piston 126. O-ring seals 128 of conventional construction will provide a good seal against the passage of the barrier fluid between the floating piston and the inner walls of reference pressure chamber 116. Resilient or elastomeric seals such as O-ring seals 128 generally are impervious to but may permit a minute but measurable permeation of gas through the seal. Use of the barrier fluid adjacent to the floating piston will therefore retard passage of gas through the liquid-elastomeric seal system. A similar barrier fluid is also provided in barrier fluid cavity 90 located above reference pressure chamber 116. In addition to acting in much the same manner as the barrier fluid adjacent floating piston 126 the barrier fluid in cavity 90 will provide additional sealing integrity against the loss of pressurized gas by permeation through seal leak paths at the upper surface of the reference pressure chamber. The barrier fluid contained in cavity 90 is under a pressure greater than the dome pressure in reference pressure chamber 116. Primary coil spring 114, which abuts a lower shoulder 123, acts on a shiftable booster sleeve member 100 which comprises a piston movable relative to control piston 60. The upper end of booster sleeve 100 comprises the lower surface of barrier fluid cavity 90. The other surfaces of barrier fluid cavity 90 are defined by an outer surface of control piston 60 and an inner cylindrical surface of port sub 74. The force acting on the lower surface of booster sleeve 100 is equal to the force developed by the dome pressure times the area of the booster sleeve plus the force of primary spring 114. This force is balanced only to the barrier fluid pressure times the area of the booster sleeve. Therefore the barrier fluid pressure is greater than the dome pressure by an amount equal to the spring force divided by booster sleeve area. Thus for the nitrogen or other gas in the reference pressure chamber to escape, the gas must migrate in a direction in which the pressure increases. The only way for the gas to escape past the barrier fluid in cavity 90 would be for the gas to migrate through imperfections in the seals or permeate the seals; go into solution in the barrier fluid which is at a pressure greater than the pressure of the gas; and then come out of solution and pass through an upper seal.

Relatively precise actuation of piston 60 can now be accomplished by increasing the tubing-casing annulus pressure, thus resulting in a pressure greater than the reference pressure, stabilized by the use of the barrier fluid in the reference pressure chamber and by the barrier fluid subjected both to the reference pressure and to a spring load. An increase in annulus pressure and this pressure in actuating chamber 98 will cause piston 60 to move downward against the spring action of the dome reference pressure and the primary spring 114. Downward movement of control piston 60 is transmitted through thrust sleeve 152 and through steel balls 162 to thrust mandrel 150. Thrust mandrel 150 can move downward against the force exerted by secondary spring 180. Downward movement of thrust mandrel 150 is transmitted to production tube 12 which in turn causes downward movement of safety valve pivot arm 222. This mechanical action causes the ball valve head 224 to rotate about a transverse axis to align the central flow passage the ball valve head with the central tubing and open the valve. Flow through the safety valve can then pass through flow ports 194 in the production tube and pass in the annulus between the subsurface control 8 and by-pass landing nipple 6. A reduction in tubing-casing annulus pressure will permit upward movement of control piston 60 resulting in closure of the valve. If however the annulus pressure increases above a prescribed level because of leaks in the tubing or other unforeseen complications continued downward movement of control piston 60 will result when the preloaded compression force in spring 178 is exceeded. Production tube 12 then bottoms out on ball valve. Spring 178 is compressed. Pre-compression of 178 provides operating range for the system. Continued downward movement of control piston 60 will eventually bring steel balls 160 into alignment with annular groove 170 on release sleeve 156. The ball will be cammed outwardly into this groove thus freeing thrust mandrel 150 and release sleeve 156 to be urged upward relative to control piston 60 by the compressed springs 180 and 228. Upward movement of the thrust mandrel-release sleeve assembly is resisted only by a relatively weak spring 154. Upward movement of the thrust mandrel will of course permit safety valve 16 to close despite the differential annulus pressure tending to move the control piston in the actuating direction.

When the pressure is bled off of the tubing-casing annulus, nitrogen pressure in the reference pressure chamber will not exceed annulus pressure acting in annulus pressure actuating cavity 98. This reference pressure force together with the action of primary spring 114 will move control piston assembly 60 back to its original position. As this occurs the thrust sleeve passes under the steel balls and the thrust of the spring above the release sleeve forces the balls back into the thrust sleeve groove. Since the release sleeve is no longer retained by the balls, its spring pushes it back down to its original position. Now the control is back in its original position and if annulus pressure is reapplied, the safety valve will reopen.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a subterranean well tool having a shiftable member, reciprocal in response to a force differential between opposite surfaces of said shiftable member, the force on one surface of said shiftable member comprising a force generated by the pressure of a gas; the improvement comprising a barrier fluid relatively impervious to the passage therethrough of the gas, said barrier fluid being located between said gas and a region at a pressure differing from the pressure of said gas, said barrier fluid being at a pressure in excess of said reference pressure to retard passage of said gas into said barrier fluid.

2. The subterranean well tool of claim 1 further comprising a second shiftable member between said reference pressure chamber and said barrier fluid, said second shiftable member being biased so that the pressure of said barrier fluid is greater than said reference pressure.

3. The subterranean well tool of claim 2 wherein said second shiftable member is spring biased.

4. The subterranean well tool of claim 3 wherein the force exerted by said barrier fluid on said second shiftable member is equal to the sum of the force exerted by the reference pressure and the spring force acting on said second shiftable member.

5. The subterranean well tool of claim 2 wherein said second shiftable member is adjacent to and movable relative to said first mentioned shiftable member with resilient sealing means establishing sealing integrity along adjacent surfaces of said first and second shiftable members between said reference pressure chamber and said barrier fluid.

6. The subterranean well tool of claims 2, 3, 4 or 5 wherein said first and second shiftable members comprise pistons longitudinally movable relative to a stationary cylindrical member, the surfaces defining said reference pressure chamber comprising surfaces on said first and second shiftable members and said stationary cylindrical member.

7. The subterranean well tool of claim 6 wherein said barrier fluid is contained in a barrier fluid chamber, other surfaces on said first and second shiftable members and said stationary cylindrical member comprising surfaces defining said barrier fluid chamber.

8. The subterranean well tool of claim 3 further comprising a floating piston in said reference pressure chamber initially movable under the action of an external force to change the volume of said reference pressure chamber to determine said reference pressure.

9. The subterranean well tool of claim 8 wherein said floating piston is movable in response to subterranean well conditions.

10. The subterranean well tool of claim 9 further comprising locking means engagable to stabilize the pressure acting on said floating piston and prevent further changes in said preference pressure.

11. In a subterranean well tool having a shiftable member, reciprocal in response to a force differential between opposite surfaces of said shiftable member, the force on one surface of said shiftable member comprising a force generated by the pressure of a gas in a reference pressure chamber; the improvement comprising a barrier fluid relatively impervious to the passage therethrough of the gas in said reference pressure chamber, said barrier fluid being located between said reference pressure chamber and a region at a pressure differing from the pressure in said reference pressure chamber, said barrier fluid being at a pressure in excess of said reference pressure to retard passage of said gas into said barrier fluid.

12. The subterranean well tool of claim 11 further comprising a barrier fluid chamber, said barrier fluid filling said barrier fluid chamber.

13. The subterranean well tool of claim 12 further comprising resilient sealing means on opposite sides of said barrier fluid chamber.

14. The subterranean well tool of claim 11 further comprising resilient sealing means between said reference pressure chamber and said barrier fluid.

15. The subterranean well tool of claims 13 or 14 wherein said resilient sealing means comprise means for establishing sealing integrity along a surface of said shiftable member.

16. The subterranean well tool of claim 11 wherein said shiftable member is movable in response to variable pressure, said barrier fluid being located between the reference pressure chamber and a region of variable pressure.

17. The subterranean well tool of claim 16 wherein a surface on said shiftable member is exposed to said region of variable pressure, said shiftable member moving in response to pressure variations in said region.

18. An apparatus responsive to the difference between a variable force acting at one end thereof and a reference pressure force, comprising:

a reference pressure chamber containing a gas at the reference pressure;

a first piston exposed to the reference pressure force of the gas in said chamber;

first seal means engaging said first piston means for preventing liquid communication along the surface of said first piston means;

a second piston between said reference pressure chamber and said first seal means;

a barrier liquid, relatively impermeable to the passage of gas therethrough, positioned between said second piston and said first seal means;

second seal means for preventing communication between said barrier fluid and the gas in said reference pressure chamber; and biasing means in said reference pressure chamber acting on said second piston for exerting a force on said barrier liquid so that the barrier liquid pressure exceeds the pressure of said gas to retard leakage of said gas from said reference pressure chamber.

19. The apparatus of claim 18 wherein said biasing means comprise spring means.

20. The apparatus of claim 18 wherein said first piston is movable with said second piston.

21. The apparatus of claim 18 wherein the gas in said reference pressure chamber is compressed having a pressure in excess of atmospheric pressure.

22. The apparatus of claim 18 wherein the force acting on said first piston comprises the sum of the reference pressure force and the force exerted by said biasing means.

23. The apparatus of claim 22 wherein said barrier liquid comprises a relatively incompressible liquid, the sum of the reference pressure force and the force exerted by said biasing means being transmitted from said second piston through said barrier fluid to said first piston.

24. The apparatus of claim 18 wherein said first and second seal means comprise resilient seal means.

25. The apparatus of claim 18 wherein said first piston means comprises a first surface defining said reference pressure chamber.

26. The apparatus of claim 25 wherein said second piston means comprises a second surface defining said reference pressure chamber.

27. An improved flow control apparatus for use in a subterranean well in which a piston is movable in response to the pressure differential between the gas in a reference pressure chamber and the pressure in the well; the improvement comprising: a sealed member comprising the lower surface of said reference pressure chamber; a barrier fluid, relatively impermeable to the passage of gas therethrough located on said sealed member at the bottom of said reference pressure chamber; an upper seal at the top of said reference pressure chamber; a cavity below said upper seal and separate from said reference pressure chamber containing a barrier fluid, relatively impermeable to the passage of gas therethrough; and biasing means acting on said barrier fluid in said cavity in addition to the pressure in said reference pressure chamber with the resultant pressure on said barrier fluid in said cavity being greater than the pressure of gas in said reference pressure chamber, whereby said barrier fluid acts to prevent the passage of the gas in said reference pressure chamber past the seals at the top and bottom of said reference pressure chamber.

28. The apparatus of claim 27 wherein said biasing means is located within said reference pressure chamber.

* * * * *